US006691959B1

(12) United States Patent
Dancy

(10) Patent No.: US 6,691,959 B1
(45) Date of Patent: Feb. 17, 2004

(54) REFUSE BAG HOLDER

(76) Inventor: James H. Dancy, 3408 24th St. South East, Washington, DC (US) 20020

( * ) Notice: Subject to any disclaimer, the term of this patent is extended or adjusted under 35 U.S.C. 154(b) by 0 days.

(21) Appl. No.: 10/180,689

(22) Filed: Jun. 27, 2002

(51) Int. Cl.[7] ..... B65B 67/04

(52) U.S. Cl. ..... 248/100; 248/95; 248/99; 294/145

(58) Field of Search ..... 248/690, 95, 99, 248/101, 97, 682, 120; 294/146, 145, 165, 137; 383/6

(56) References Cited

U.S. PATENT DOCUMENTS 199,507 A * 1/1878 Brubaker
214,721 A * 4/1879 Smith
463,354 A * 11/1891 Jeans
868,269 A * 10/1907 Hulbert
895,759 A * 8/1908 Hulbert
1,086,218 A * 2/1914 Reed
1,548,986 A * 8/1925 Donovan
2,064,696 A * 12/1936 Smith et al. ..... 43/55
2,462,973 A * 3/1949 Kelrick ..... 248/101
3,653,624 A * 4/1972 Abel ..... 248/312
3,814,359 A * 6/1974 Powell ..... 248/99
3,841,592 A * 10/1974 Witten ..... 248/101
4,312,489 A * 1/1982 Paetzold ..... 248/97
4,940,201 A * 7/1990 Kurth ..... 248/101
5,373,654 A * 12/1994 Whalen ..... 40/152.1
5,456,431 A * 10/1995 Ilnisky ..... 248/98

* cited by examiner

*Primary Examiner*—Leslie A. Braun
*Assistant Examiner*—Steven Marsh

(57) ABSTRACT

A refuse bag holder for holding a collapsible bag in an open orientation includes a mount portion including an elongate member having an upper end and lower end. A hook is attached to the upper end. A loop is hingedly coupled to the elongate member by a hinge and is positioned on an opposite side of the elongate member with respect to the hook. The loop has an outer surface and an inner surface. A coupling member removably attaches the refuse bag to the loop. A securing member releasably secures the loop in a generally horizontal position. An edge of a refuse bag may be extended between the loop and the coupling member such that the refuse bag is held in an open orientation.

6 Claims, 3 Drawing Sheets

REFUSE BAG HOLDER

BACKGROUND OF THE INVENTION

1. Field of the Invention

The present invention relates to bag holders and more particularly pertains to a new bag holders for holding a collapsible bag in an open orientation.

2. Description of the Prior Art

The use of bag holders is known in the prior art. U.S. Pat. No. 5,020,751 describes a device for holding a bag in an open position against a fence. Another type of bag holders is U.S. Pat. No. 5,163,645 having a loop portion for holding open a bag in a vertical orientation.

While these devices fulfill their respective, particular objectives and requirements, the need remains for a device that includes a hook for attaching the device to multiple vertical surfaces such as fences or tailgates of a pick-up.

SUMMARY OF THE INVENTION

The present invention meets the needs presented above by including a hook mounted on an upper end of an elongate member for mounting the elongate member on a fence or other type of vertical wall.

Still yet another object of the present invention is to provide a new bag holders that has a foot portion for stabilizing the elongate member in a vertical orientation.

Even still another object of the present invention is to provide a new bag holders that includes grappling hooks for holding the device in a secure manner on a chain-link fence.

To this end, the present invention generally comprises a mount portion including an elongate member having an upper end and lower end. A hook is attached to the upper end. A loop is hingedly coupled to the elongate member by a hinge and is positioned on an opposite side of the elongate member with respect to the hook. The loop has an outer surface and an inner surface. A coupling member removably attaches the refuse bag to the loop. A securing member releasably secures the loop in a generally horizontal position. An edge of a refuse bag may be extended between the loop and the coupling member such that the refuse bag is held in an open orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
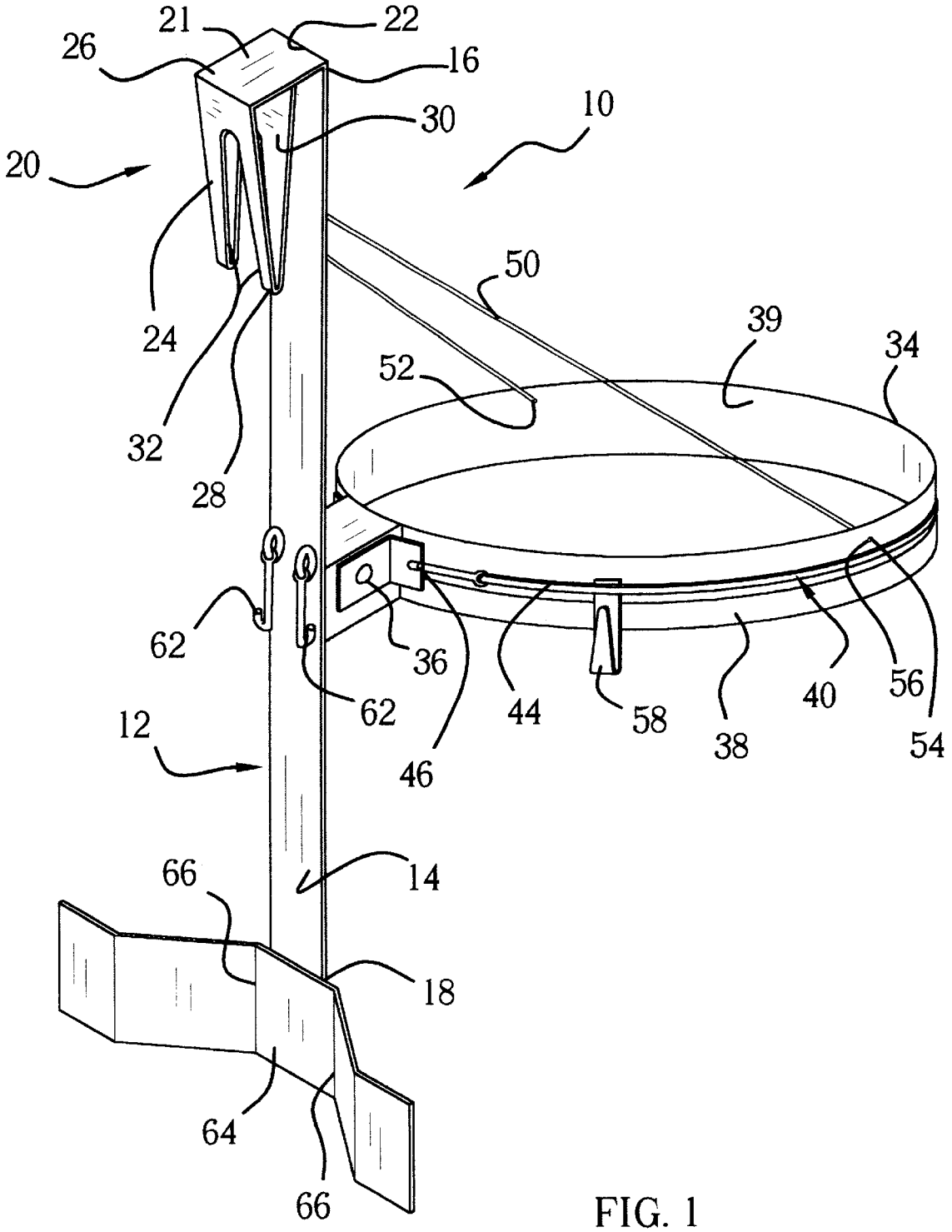
FIG. 1 is a schematic perspective view of a refuse bag holder according to the present invention.
Figure 2:
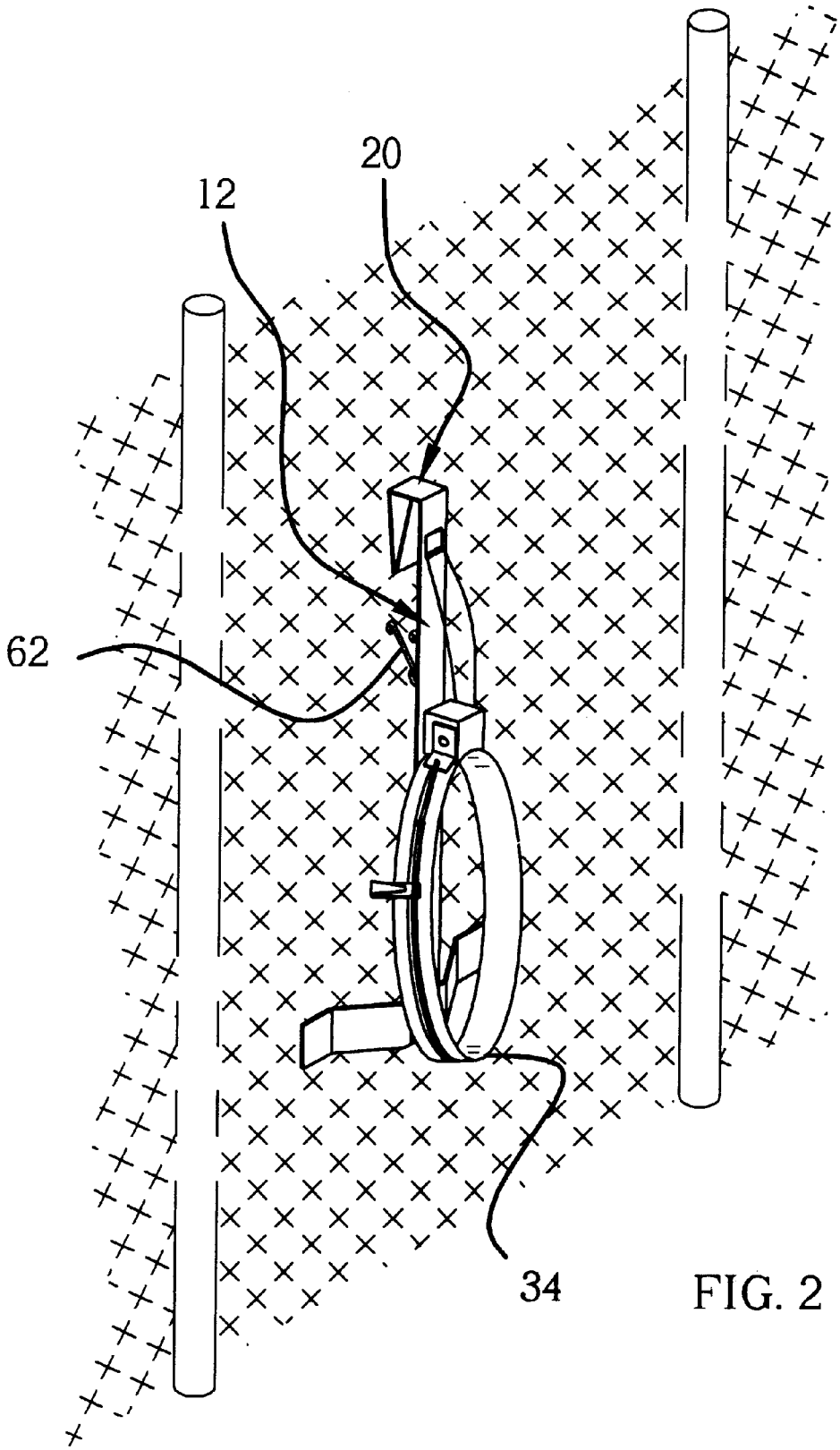
FIG. 2 is a schematic perspective view of the present invention.
Figure 3:
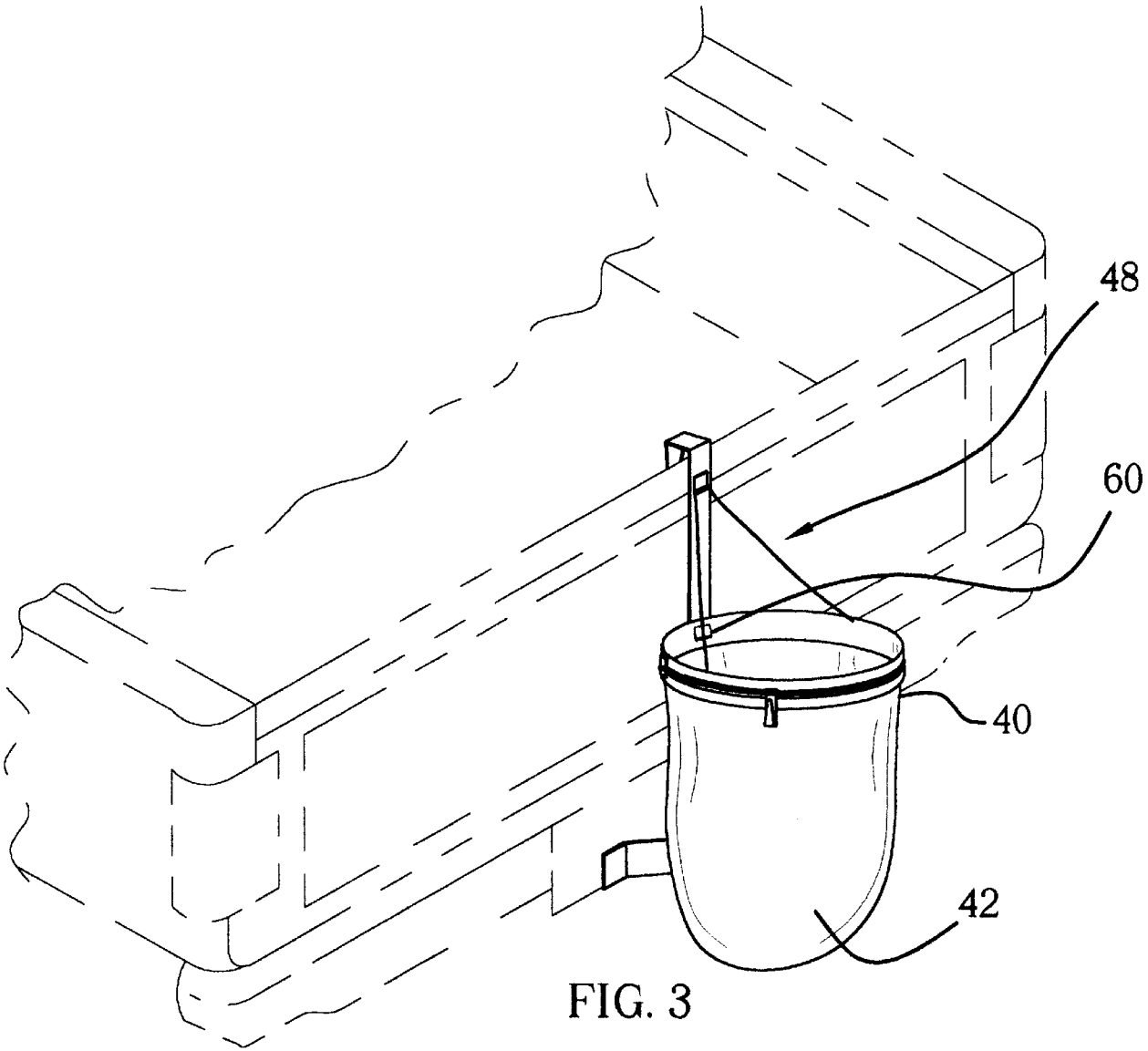
FIG. 3 is a schematic perspective view of the present invention.

With reference now to the drawings and in particular to FIGS. 1 through 3 thereof, a new bag holders embodying the principles and concepts of the present invention and generally designated by the reference numeral 10 will be described.

As best illustrated in FIGS. 1 through 3, the refuse bag holder 10 generally comprises a mount portion 12 including an elongate member 14 having an upper end 16 and lower end 18. A hook 20 is attached to the upper end 16 and includes a horizontal portion 21 having a first end 22 attached to the upper end 16. A vertical portion 24 is attached to a second end 26 of the horizontal portion 21. The vertical portion 24 extends downward and has a free end 28. A brace 30 is attached to the free end 28. The brace 30 extends upwardly toward a juncture of the elongate member 14 and the horizontal portion 20. A notch 32 extends upwardly through the vertical portion 24 and the brace 30. The hook 20 may be placed over a fence, tailgate or other vertical structure. Alternatively, a nail or other protruding member extending from a wall may be positioned in the notch 32 for holding the device 10 on the wall.

A loop 34 is hingedly coupled to the elongate member 12 by a hinge 36 and is positioned on an opposite side of the elongate member 12 with respect to the hook 20. The loop 34 has an outer surface 38 and an inner surface 39. The loop 34 preferably has a circular shape.

A coupling member 40 for removably attaching a refuse bag 42 to the loop 34 comprises an elastic band 44 having a pair of ends 46 attached to the hinge 36. The elastic band 44 is extendable around the loop 34 such that the band 44 abuts the outer surface 38.

A securing member 48 for releasably securing the loop 34 in a generally horizontal position preferably comprises an elongated rod 50 having a first end 52 and a second end 54. A middle portion of the elongated rod 50 is pivotally coupled to the elongate member 50 and is positioned generally between the loop 34 and the upper end 22. Each of the first 52 and second ends 54 of the securing member 48 is removably extendable through apertures 56 in the loop 34. The securing member 48 may be comprised of a metal or may be a flexible material. Preferably it is a metal having bends in the end to form hooks for extending through apertures 56.

A bag hook 58 is attached to the outer surface 38 of the loop. The bag hook 58 aids in holding the refuse bag 42 or for holding a plurality of refuse bags. Also, a clamp 60 for holding refuse bags may be positioned on an inner surface 39 of the loop 34 for holding empty refuse bags.

A pair of grappling hooks 62 is pivotally attached to the elongate member 12 and is positioned generally opposite of the loop 34. The grappling hooks 62 may be used for adding support to the device 10, such as attaching the elongate member 12 to a chain link fence.

A foot portion 64 is attached to the elongate member 12 and is positioned generally adjacent to the lower end 18. The foot portion 64 generally extends in a direction opposite of the loop 34. The foot portion 64 is generally elongated in a horizontal orientation and has a pair of bends 66 therein so that ends of the foot portion 64 extend away from the elongate member 12.

In use, the elongate member 12 is mounted on a vertical surface as shown in FIGS. 2 and 3. The loop 38 is then positioned in a horizontal position with the securing member 48. An edge of the refuse bag 42 may be extended between the loop 34 and the coupling member 40 such that the refuse bag 42 is held in an open orientation.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refuse bag holding device, said device being removably mountable on a vertical surface, said device comprising:

a mount portion including an elongate member having an upper end and lower end, a hook being attached to said upper end, said hook including a horizontal portion having a first end attached to said upper end, a vertical portion being attached to a second end of said horizontal portion, said vertical portion extending downward and having a free end, a brace being attached to said free end, said brace extending upwardly toward a juncture of said elongate member and said horizontal portion;

a loop being hingedly coupled to said elongate member by a hinge and being positioned on an opposite side of said elongate member with respect to said hook, said loop having an outer surface and an inner surface;

a coupling member for removably attaching the refuse bag to said loop;

a pair of grappling hooks being pivotally attached to said elongate member and being positioned opposite of said loop, a securing member for releasably securing said loop in a generally horizontal position; and wherein an edge of the refuse bag may be extended between said loop and said coupling member such that said refuse bag is held in an open orientation.

2. The refuse bag holding device as in claim 1, wherein a notch extends upwardly through said vertical portion and said brace.

3. The refuse bag holding device as in claim 1, wherein said coupling member comprises an elastic band having a pair of ends attached to said hinge, said elastic band being extendable around said loop such that said band abuts said outer surface.

4. The refuse bag holding device as in claim 1, wherein said securing member comprises an elongated rod having a first end and a second end, a middle portion of said elongated rod being pivotally coupled to said elongate member and being positioned generally between said loop and said upper end, each of said first and second ends of said securing member being removably extendable through apertures in said loop.

5. The refuse bag holding device as in claim 1, further including a foot portion being attached to said elongate member and being positioned generally adjacent to said lower end, said foot portion generally extending in a direction opposite of said loop.

6. A refuse bag holding device, said device being removably mountable on a vertical surface, said device comprising:

a mount portion including an elongate member having an upper end and lower end, a hook being attached to said upper end, said hook including a horizontal portion having a first end attached to said upper end, a vertical portion being attached to a second end of said horizontal portion, said vertical portion extending downward and having a free end, a brace being attached to said free end, said brace extending upwardly toward a juncture of said elongate member and said horizontal portion, a notch extending upwardly through said vertical portion and said brace;

a loop being hingedly coupled to said elongate member by a hinge and being positioned on an opposite side of said elongate member with respect to said hook, said loop having an outer surface and an inner surface;

a coupling member for removably attaching the refuse bag to said loop, said coupling member comprising an elastic band having a pair of ends attached to said hinge, said elastic band being extendable around said loop such that said band abuts said outer surface;

a securing member for releasably securing said loop in a generally horizontal position, said securing member comprising an elongated rod having a first end and a second end, a middle portion of said elongated rod being pivotally coupled to said elongate member and being positioned generally between said loop and said upper end, each of said first and second ends of said securing member being removably extendable through apertures in said loop;

a bag hook being attached to said outer surface of said loop;

a pair of grappling hooks being pivotally attached to said elongate member and being positioned generally opposite of said loop;

a foot portion being attached to said elongate member and being positioned generally adjacent to said lower end, said foot portion generally extending in a direction opposite of said loop; and wherein an edge of the refuse bag may be extended between said loop and said coupling member such that said refuse bag is held in an open orientation.

* * * * *